US011291321B2

(12) United States Patent
Pontecorvo

(10) Patent No.: US 11,291,321 B2
(45) Date of Patent: Apr. 5, 2022

(54) RECYCLABLE OR REUSABLE STRAW IN CONTAINER LID ASSEMBLY

(71) Applicant: Gary J. Pontecorvo, Stockton, NJ (US)

(72) Inventor: Gary J. Pontecorvo, Stockton, NJ (US)

( * ) Notice: Subject to any disclaimer, the term of this patent is extended or adjusted under 35 U.S.C. 154(b) by 143 days.

(21) Appl. No.: 16/735,423

(22) Filed: Jan. 6, 2020

(65) Prior Publication Data

US 2021/0204728 A1 Jul. 8, 2021

(51) Int. Cl.

| | |
|---|---|
| ***A47G 19/22*** | (2006.01) |
| ***A47G 21/18*** | (2006.01) |
| ***B65D 43/02*** | (2006.01) |
| ***B65D 53/00*** | (2006.01) |
| ***B65D 43/26*** | (2006.01) |

(52) U.S. Cl.

CPC ..... *A47G 19/2222* (2013.01); *A47G 21/189* (2013.01); *B65D 43/0202* (2013.01); *B65D 43/26* (2013.01); *B65D 53/00* (2013.01)

(58) Field of Classification Search

CPC ..... A47G 19/2222; A47G 21/189; A47G 19/2266; B65D 43/0202; B65D 43/26; B65D 53/00; B65D 47/06; B65D 47/32; B65D 51/16; B65D 2205/02; B65D 2543/00046; B65D 2547/063

See application file for complete search history.

(56) References Cited

U.S. PATENT DOCUMENTS 4,615,457 A * 10/1986 Harding ..... B65D 77/28 220/708
4,736,887 A * 4/1988 Inaba ..... A47G 21/189 239/33
5,957,279 A 9/1999 Howes (Continued)

FOREIGN PATENT DOCUMENTS

JP 2009233348 A * 10/2009
WO WO-0185575 A1 * 11/2001 ..... B65D 51/24

(Continued)

OTHER PUBLICATIONS

International Search Report, dated Mar. 8, 2021, for corresponding PCT Application No. PCT/US2020/067636, International Filing Date of Dec. 31, 2020, consisting of 2 Pages.

(Continued)

*Primary Examiner* — Valentin Neacsu
*Assistant Examiner* — John Martin Hoppmann
(74) *Attorney, Agent, or Firm* — Gearhart Law, LLC; David Postolski, Esq.

(57) ABSTRACT

A recyclable or reusable assembly is described. The assembly includes a lid having a first side disposed opposite a second side that engages an opening of a container and a hole extending through a width of the lid. A corrugated flex pipe configured straw fully extendable for use of the assembly is configured to collapse on itself in a telescoping movement and has a first and a second portion. A second side of the first portion engages the hole on the first side of the lid and a second side of the second portion engages the hole on the second side of the lid. A first sealing plug is affixed to the first side of the first portion of the straw and a second sealing plug is affixed to the first side of the second portion of the straw to seal an inside of the straw.

15 Claims, 9 Drawing Sheets

(56) References Cited

U.S. PATENT DOCUMENTS

| | | | | |
|---|---|---|---|---|
| 6,102,568 | A | 8/2000 | Davis | |
| 6,427,928 | B1 * | 8/2002 | Hirota | B65D 77/283 215/229 |
| 7,823,802 | B1 * | 11/2010 | Roche | B65D 75/5877 239/33 |
| 8,579,148 | B2 | 11/2013 | Slansky | |
| 8,584,966 | B2 * | 11/2013 | Roche | A47G 21/189 239/33 |
| 10,011,413 | B1 * | 7/2018 | Ryan | B65D 75/5827 |
| 10,123,641 | B1 | 11/2018 | Pepper | |
| 10,165,849 | B2 | 1/2019 | Chen | |
| 2006/0165928 | A1 * | 7/2006 | Suzuki | B32B 7/14 428/35.7 |
| 2006/0080593 | A1 * | 8/2006 | Francetta | A47G 19/22 220/705 |
| 2008/0223818 | A1 | 9/2008 | Shafik | |
| 2011/0057050 | A1 * | 3/2011 | Shakur-Jenkins | A47G 21/186 239/33 |
| 2011/0163102 | A1 * | 7/2011 | Haynie | B65D 51/28 220/521 |
| 2011/0315698 | A1 | 12/2011 | Donaldson et al. | |
| 2013/0200088 | A1 | 8/2013 | Muir, III | |
| 2016/0145011 | A1 | 5/2016 | Savel | |
| 2016/0200486 | A1 * | 7/2016 | Meyers | B65D 47/247 215/229 |
| 2016/0309930 | A1 * | 10/2016 | Stewart | A47G 21/18 |
| 2017/0112306 | A1 | 4/2017 | Muir, III | |
| 2017/0253363 | A1 * | 9/2017 | Feeley | A47G 19/02 |
| 2019/0038058 | A1 | 2/2019 | Abbott-Glazier | |
| 2019/0099025 | A1 | 4/2019 | Rieger | |
| 2020/0339314 | A1 * | 10/2020 | Meyers | A47G 19/2266 |

FOREIGN PATENT DOCUMENTS

| | | | |
|---|---|---|---|
| WO | 2011120037 | A2 | 9/2011 |
| WO | 2011127566 | A1 | 10/2011 |
| WO | WO-2015117213 | A1 * | 2/2015 |

OTHER PUBLICATIONS

Written Opinion of the International Searching Authority, dated Mar. 8, 2021, for corresponding PCT Application No. PCT/US2020/067636, International Filing Date of Dec. 31, 2020, consisting of 9 Pages.

* cited by examiner

RECYCLABLE OR REUSABLE STRAW IN CONTAINER LID ASSEMBLY

FIELD OF THE EMBODIMENTS

The field of the invention and its embodiments relate to recyclable or reusable lid and straw assemblies configured to engage a container. In particular, the present invention and its embodiments provide both a reusable and spill-proof container assembly that is dishwasher safe and a recyclable lid and straw assembly that increases the likelihood that traditionally used recycling equipment will recycle the assembly.

BACKGROUND OF THE EMBODIMENTS

With an increased emphasis on environmental protection efforts, elimination of common plastic straws has received increased media attention. Plastic straws are a single-use product and are available in numerous sizes. However, due to their popularity, it has been estimated that Americans use over 500 million plastic straws each day. Though these common plastic straws can technically be recycled, plastic straws are small, thin, and easily bendable. The lightweight nature of these straws results in them falling into cracks and crevices of recycling machinery, and as such, most recyclers do not accept plastic straws, and most straws that do make it to a recycling facility do not become recycled. As such, most of these plastic straws end up polluting the oceans or being dumped into landfills.

To remedy this pollution crisis, many cities and countries have restricted use of single-use plastic straws. An alternative to use of plastic straws is use of reusable straws, which may be made out of stainless steel or glass, for example. Though these reusable straws are dishwasher-safe, they are often difficult to clean, must be carried by the user, and are costly to purchase. Others have contemplated use of recyclable paper straws as a greener option to single-use plastic straws. Though recyclable paper straws are biodegradable, take less time to decompose, as compared to plastic straws, and are safer for wildlife, recyclable paper straws quickly lose their form, and therefore their usefulness, when submerged in a liquid.

Thus, a need exists for a reusable and spill-proof container assembly that is dishwasher safe. A need also exists for a recyclable lid and straw assembly that increases the likelihood that traditionally used recycling equipment will recycle the assembly.

REVIEW OF RELATED TECHNOLOGY

U.S. Pat. No. 6,102,568 A relates to a collapsible, recyclable, fluid receptacle readily assembled from either single blank or two substantially identical blanks to form an outer shell and a flexible inner liner attached to the shell to retain a liquid therein without leaking.

U.S. Pat. No. 8,579,148 B2 describes a reusable straw that includes a first part having a hollow elongated body that has a first end and an opposing second end and a second part having a hollow elongated body that has a first end and an opposing second end. The second part has a width that allows the first part to be received within a hollow interior of the first part. A first coupling member is formed along an inner surface of the first part proximate the first end. A second coupling member is formed along an outer surface of the second part at the first end thereof. The first and second coupling members mate together to securely couple the second part to the first part.

U.S. Pat. No. 10,011,413 B1 describes a drinking straw wrapper that comprises an upper portion and a lower portion detachably engaged with the upper portion. The upper and lower portions are collectively configured to enclose a drinking straw. Detachment of the upper portion from the lower portion creates an opening in the upper portion and an opening in the lower portion, with the opening in the upper portion being substantially wider than the opening in the lower portion so as to facilitate replacement of the upper portion on a top of the straw after its initial removal therefrom. The upper portion may be formed from a first material and the lower portion formed from a second material different than the first material. Alternatively, the upper portion may be formed from a material having a first thickness and the lower portion formed from a same material but having a second thickness that is less than the first thickness.

U.S. Pat. No. 10,123,641 B1 describes a reusable drinking straw that is foldable into a compact configuration for storage. The straw comprises a rigid external tube and a flexible internal tube that is foldable into a compact configuration for storage. In a folded configuration, the reusable straw has a significantly reduced length. The external tube of the straw is preferably formed of multiple rigid segments for supporting the flexible internal tubing in the extended configuration during use as a drinking straw.

U.S. Pat. No. 10,165,849 B2 describes a collapsible, reusable drinking container that has a first opening suitable for pouring and filling, a second opening for accessing the interior of the container for cleaning, and a flexible straw for drinking the contents while the container is held in an upright position.

U.S. Patent Application Publication No. 2011/0315698 A1 describes a multiple straw fluid dispenser that includes a cap assembly containing two or more straws, where each of the two or more straws are accessible to one or more users for the purpose of drinking one or more fluids.

WO 2011/120037 A2 describes a drinking straw that can be easily inserted through a lid or into a beverage pouch or box.

U.S. Patent Application Publication No. 2013/0200088 A1 relates to drink-through lids that may be placed over and attached to disposable and reusable beverage cups. The drink-through lids provide a drink-through opening near the perimeter of the lid's top surface for easy drinking.

WO 2011/127566 A1 describes a collapsible container that is movable from a collapsed position (having a reduced volume for storage and transport) and an expanded position (having dimensional rigidity to securely hold the contents of the container).

U.S. Patent Application Publication No. 2016/0145011 A1 describes a resilient lid insert or membrane construction that is outfitted upon a lidded beverage container for enabling the user to transfer heat from a relatively hot assembly-contained beverage prior to consumption.

U.S. Patent Application Publication No. 2017/0112306 A1 describes anti-spill disposable and reusable drink-through lids for hot and cold disposable and reusable beverage cups. The drink-through lids may be placed over and attached to disposable and reusable beverage cups.

U.S. Patent Application Publication No. 2019/0038058 A1 describes a reusable straw assembly. The assembly includes an inner and outer member which, when fitted together, form the straw. Each member has a tab at one end to inhibit the member from falling out of a dishwasher while the member is being washed. Each member includes a gap in its tubal shape. The gap runs along its longitudinal length. The gap allows for better access to its interior for cleaning and disinfecting. In operation, the inner member translates inside the outer member in preparation for use. Moreover, the inner member translates out of the outer member in preparation for cleaning.

U.S. Patent Application Publication No. 2019/0099025 A1 describes a reusable combination corrugated drinking straw. The drinking straw has an elongated tubular body with a fluid passage running therethrough. The tubular body is manufactured from metal (e.g., stainless steel) and has a plurality of corrugations extending radially outward therefrom. The tubular body is flexible and is adapted to be bent so as to enable a user of the corrugated drinking straw to sip a beverage from a cup.

Various references describe attempts at remedying the factors contributing to the difficulties associated with single-use plastic straws. However, a need exists for a recyclable or reusable lid and straw assemblies configured to engage a container. In particular, a need exists for both a reusable and spill-proof container assembly that is dishwasher safe and a recyclable lid and straw assembly that increases the likelihood that traditionally used recycling equipment will recycle the assembly. The present invention and its embodiments relate to recyclable or reusable lid and straw assemblies. Multiple embodiments of this invention are presented in the drawings and will be described in more detail herein.

SUMMARY OF THE EMBODIMENTS

The present invention and its embodiments relate to recyclable or reusable lid and straw assemblies configured to engage a container. In particular, the present invention and its embodiments provide both a reusable and spill-proof container assembly that is dishwasher safe and a recyclable lid and straw assembly that increases the likelihood that traditionally used recycling equipment will recycle the assembly.

According to a first embodiment of the present invention, a recyclable assembly is described. The recyclable assembly includes a lid and a straw. The lid has a first side disposed opposite a second side and a hole located in a middle of the lid such that the hole extends through a width of the lid. The second side of the lid engages an opening of a container to form a closed container. The straw is fully extendable for use and is configured to collapse on itself in a telescoping movement. The straw has a first portion disposed opposite a second portion. The first portion of the straw has a first side disposed opposite a second side. The second portion of the straw has a first side disposed opposite a second side. The second side of the first portion of the straw is configured to engage the hole on the first side of the lid. The second side of the second portion of the straw is configured to engage the hole on the second side of the lid. The second portion of the straw resides inside of the closed container.

In some examples, a first sanitary film may be wrapped around and may encompass the lid. Further, a second sanitary film may be wrapped around and may encompass the straw. In additional examples, the assembly may include a sanitary film wrapped around and encompassing the recyclable assembly.

In further examples, the lid and the straw may be manufactured as one piece. In other examples, the lid and the straw may be manufactured as separate pieces. In further examples, the straw may comprise a recyclable material, such as a biodegradable plastic (e.g., a biologically synthesized plastic or a petroleum-based plastic), a number 4 plastic (e.g., a low-density polyethylene (LDPE) plastic), a number 6 plastic (e.g., a polylactic acid plastic or a polystyrene plastic), and/or a paper material, among others. In other examples, the biologically synthesized plastic may be a polyhydroxyalkanoates (PHA) plastic, a polylactic acid (PLA) plastic, a starch blend plastic, or a cellulose-based plastic, among other examples not explicitly listed herein. In further examples, the petroleum-based plastic may be a polyglycolic acid (PGA) plastic, a polybutylene succinate (PBS) plastic, a polycaprolactone (PCL) plastic, a poly(vinyl alcohol) (PVOH/PVA) plastic, or a polybutylene adipate terephthalate (PBAT) plastic, among other examples not listed herein. In some examples, the lid may comprise a plastic material, a paper material, and/or a recyclable material. In other examples, the plastic material of the lid may be a biodegradable plastic, a number 4 plastic, or a number 6 plastic, among other examples.

In some examples, the assembly may comprise a first sealing plug affixed to the first side of the first portion of the straw. The assembly may also include a second sealing plug affixed to the first side of the second portion of the straw. The first sealing plug seals an inside of the first portion of the straw and the second sealing plug seals an inside of the second portion of the straw to prevent non-ingestible items from entering the first or the second portion of the straw. In other examples, the first sealing plug is removable from the first portion of the straw and the second sealing plug is removable from the second portion of the straw. In some examples, the first sealing plug and the second sealing plug each comprise at least one pull tab such that when a user pulls the at least one pull tab of the first sealing plug away from the first side of the lid or the at least one pull tab of the second sealing plug away from the second side of the lid, the first or the second sealing plug are extended to an open position and the straw is extended, via the telescoping movement, into an extended use position. In additional examples, when a user pushes the at least one pull tab of the first sealing plug towards the first side of the lid or the at least one pull tab of the second sealing plug towards the second side of the lid, the first or the second sealing plug are condensed to a closed position and the straw is collapsible, via the telescoping movement, into a closed non-use position.

A second embodiment of the instant invention describes a reusable assembly. The assembly includes a lid, a first sanitary film, a second sanitary film, and a straw. The lid has a first side disposed opposite a second side and a hole located in a middle of the lid such that the hole extends through a width of the lid. The second side of the lid engages an opening of a container to form a closed container. The first sanitary film is affixed to the first side of the lid and the second sanitary film is affixed to the second side of the lid. In examples, the first sanitary film and the second sanitary film comprise a plastic material. The straw is fully extendable for use and configured to collapse on itself in a telescoping movement. The straw has a corrugated flex pipe configuration and includes a first portion disposed opposite a second portion. The first portion of the straw has a first side disposed opposite a second side. The second portion of the straw has a first side disposed opposite a second side. The second side of the first portion of the straw is configured to engage the hole on the first side of the lid. The second side of the second portion of the straw is configured to engage the hole on the second side of the lid. The second portion of the straw resides inside of the closed container.

In some examples, the reusable assembly of the second embodiment comprises a silicone material such that the reusable assembly is dishwasher safe. In other examples, the reusable assembly may also comprise a first sealing plug affixed to the first side of the first portion of the straw and a second sealing plug affixed to the first side of the second portion of the straw. The first sealing plug seals an inside of the first portion of the straw and the second sealing plug seals an inside of the second portion of the straw to prevent non-ingestible items from entering the first or the second portion of the straw. The first sealing plug is removable from the first portion of the straw and the second sealing plug is removable from the second portion of the straw.

In other examples, the first sealing plug and the second sealing plug each comprise at least one pull tab. In some examples, the first sanitary film is affixed to the first sealing plug and the second sanitary film is affixed to the second sealing plug such that when a user pulls the at least one pull tab of the first sealing plug away from the first side of the lid or the at least one pull tab of the second sealing plug away from the second side of the lid to extend the first or the second sealing plug to an open position, the first sanitary film or the second sanitary film is removed.

In a third embodiment, a recyclable or reusable assembly is described. The assembly comprises a lid, a first sealing plug, a second sealing plug, a first sanitary film, a second sanitary film, and a straw. The lid may have a flat shape, a substantially flat shape, a concave shape, or a domed shape, among other shapes not explicitly listed herein. The lid has a first side disposed opposite a second side and a hole located in a middle of the lid such that the hole extends through a width of the lid. The second side of the lid engages an opening of a container to form a closed container.

The first sealing plug is affixed to the first side of the lid and the second sealing plug affixed to the second side of the lid. The first sanitary film is affixed to the first sealing plug and the second sanitary film is affixed to the second sealing plug. The straw is fully extendable for use and is configured to collapse on itself in a telescoping movement. The straw has a corrugated flex pipe configuration and includes a first portion disposed opposite a second portion. The first portion of the straw has a first side disposed opposite a second side and the second portion of the straw has a first side disposed opposite a second side. The second side of the first portion of the straw has a greater width than the first side of the first portion of the straw. Moreover, the second side of the second portion of the straw has a greater width than the first side of the second portion of the straw. The second side of the first portion of the straw is configured to engage the hole on the first side of the lid. The second side of the second portion of the straw is configured to engage the hole on the second side of the lid. The second portion of the straw resides inside of the closed container.

In general, the present invention succeeds in conferring the following benefits and objectives.

It is an object of the present invention to provide a reusable lid and straw assembly, configured to engage a container, that is dishwasher safe.

It is an object of the present invention to provide a reusable lid and straw assembly, where the straw is collapsible, allowing for more efficient storage of the reusable assembly and ease of stacking multiple reusable assemblies and/or with other standard lid containers.

It is an object of the present invention to provide a recyclable lid and straw assembly, where the straw is collapsible, allowing for more efficient storage of the recyclable assembly and ease of stacking multiple recyclable assemblies and/or with other standard lid containers.

It is an object of the present invention to provide a recyclable and an environmentally friendly solution to use of a typical plastic straw.

It is an object of the present invention to provide a spill-proof container assembly.

It is an object of the present invention to provide a recyclable assembly comprising a straw affixed to a lid, where the assembly has a greater size and mass than a single plastic or recyclable straw, resulting in an increased likelihood that traditionally used recycling equipment will recycle the assembly.

DESCRIPTION OF THE PREFERRED EMBODIMENTS

Figure 1:
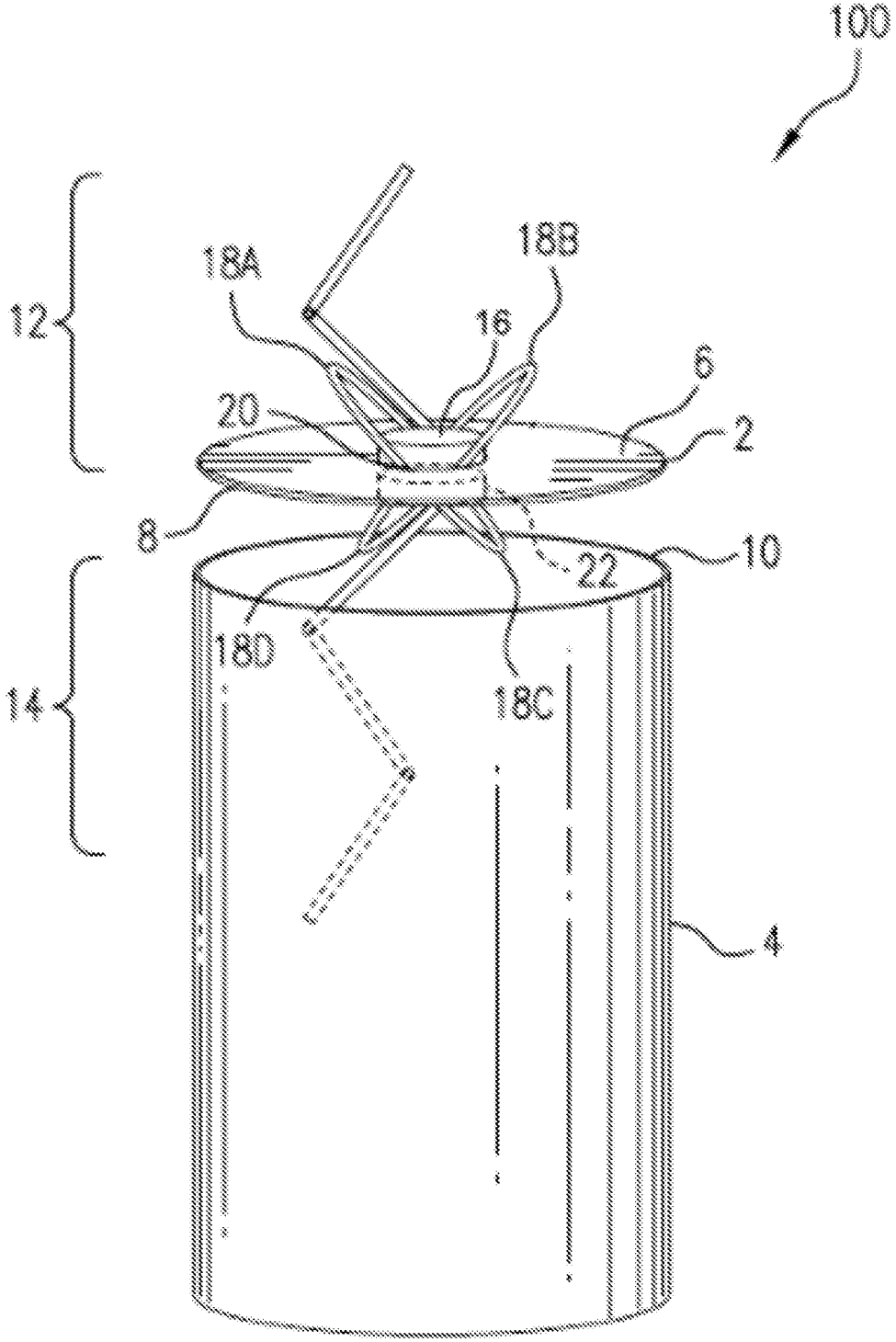
FIG. 1 is a perspective view of an embodiment of a recyclable or a reusable assembly, according to at least some embodiments described herein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

According to FIG. 1, an assembly 100 may be recyclable or reusable. In a first embodiment, the assembly 100 may be the recyclable assembly. In this embodiment, the assembly 100 may include a lid 2 and a collapsible straw fully extendable for use. According to examples, the lid 2 and the collapsible straw may be manufactured as one piece. In other examples, the lid 2 and the collapsible straw may be manufactured as separate pieces. It should be appreciated that the diameter and/or radii of the collapsible straw may vary to accommodate different types of liquids. In other examples, the radii and/or diameter of the lid 2 may vary. In examples, the lid 2 may have a flat shape, a substantially flat shape, a concave shape, or a domed shape, among other examples.

In an example, the lid 2 has no opening to insert a straw or drink through, and as such, the lid 2 is spill-proof. The lid 2 may have a first side 6 disposed opposite a second side 8. The lid 2 may also have a hole 20 located in a middle of lid 2. The hole 20 is configured to extend through a width of the lid 2. In examples, the second side 8 of the lid 2 may engage an opening 10 of a container 4 to form a closed container. It should be appreciated that the shape, size, and dimensions of the container 4 are not limited to those depicted.

The collapsible straw may include a first portion 12 disposed opposite a second portion 14. The first portion 12 of the collapsible straw may be bendable or flexible and may have a first side disposed opposite a second side. The flexibility or bendability of the first portion 12 of the collapsible straw allows the first portion 12 of the collapsible straw to bend for ease of use by someone who cannot reach the collapsible straw in a straight and an extended use position.

The first side of the first portion 12 of the collapsible straw may be configured to engage the hole 20 on the first side 6 of the lid 2. A user may place his/her lips on a second side of the first portion 12 of the collapsible straw to drink a liquid from the container 4. The closed container may house a liquid of any temperature.

The second portion 14 of the collapsible straw may include a first side disposed opposite a second side. The first side of the second portion 14 of the collapsible straw may be configured to engage the hole 20 on the second side 8 of the lid 2. The second side of the second portion 14 of the collapsible straw may reside inside of the closed container.

In some examples, the first portion 12 and the second portion 14 of the collapsible straw may comprise a recyclable material. In examples, the recyclable material may be: a biodegradable plastic (such as a biologically synthesized plastic and a petroleum-based plastic). A non-exhaustive list of the biologically synthesized plastic includes: a polyhydroxyalkanoates (PHA) plastic, a polylactic acid (PLA) plastic, a starch blend plastic, and a cellulose-based plastic. A non-exhaustive list of the petroleum-based plastic includes: a polyglycolic acid (PGA) plastic, a polybutylene succinate (PBS) plastic, a polycaprolactone (PCL) plastic, a poly(vinyl alcohol) (PVOH/PVA) plastic, and a polybutylene adipate terephthalate (PBAT) plastic.

The recyclable material of the collapsible straw may also include: a number 1 plastic (such as polyethylene terephthalate), a number 2 plastic (such as a high-density polyethylene), a number 3 plastic (such as a polyvinyl chloride), a number 4 plastic (such as a low-density polyethylene (LDPE) plastic), a number 5 plastic (e.g., polypropylene), a number 6 plastic (such as a PLA plastic or a polystyrene plastic), a number 7 plastic (e.g., BPA, polycarbonate, and LEXAN), a paper material, and combinations of these materials. In other examples, the lid 2 may comprise a biodegradable plastic, a number 4 plastic, a number 6 plastic, a paper material, a recyclable material, and combinations thereof. It should be appreciated that the recyclable material of the first portion 12 and the second portion 14 of the collapsible straw and the material comprising the lid 2 are not limited to the examples explicitly described herein.

In examples, the assembly 100 may additionally include a first sealing plug 16 affixed to the first side 6 of the lid 2 and a second sealing plug 22 affixed to the second side 8 of the lid 2. The first sealing plug 16 and the second sealing plug 22 are depicted in closed positions in FIG. 2, FIG. 3, FIG. 5 and FIG. 7 and are depicted in open positions in FIG. 6 and FIG. 8. The first sealing plug 16 and the second sealing plug 22 are both tamper-evident caps that provide a resealable closure.

In examples, the first sealing plug 16 is configured to screw onto or into the first portion 12 of the collapsible straw and the second sealing plug 22 is configured to screw onto or into the second portion 14 of the collapsible straw. The first sealing plug 16 is configured to seal an inside of the first portion 12 of the collapsible straw and the second sealing plug 22 is configured to seal an inside of the second portion 14 of the collapsible straw to prevent non-ingestible items, such as dirt, from entering the first portion 12 of the second portion 14 of the collapsible straw. In examples, the first sealing plug 16 is removable from the first portion 12 of the collapsible straw and the second sealing plug 22 is removable from the second portion 14 of the collapsible straw.

In further examples, and as depicted in FIG. 1, FIG. 2, FIG. 3, FIG. 5, FIG. 6, FIG. 7, and FIG. 8, the first sealing plug 16 comprises one or more pull tabs 18A, 18B and the second sealing plug 22 comprises one or more pull tabs 18C, 18D. The first sealing plug 16, the second sealing plug 22, and the one or more pull tabs 18A, 18B, 18C, 18D comprise a recyclable material.

Figure 6:
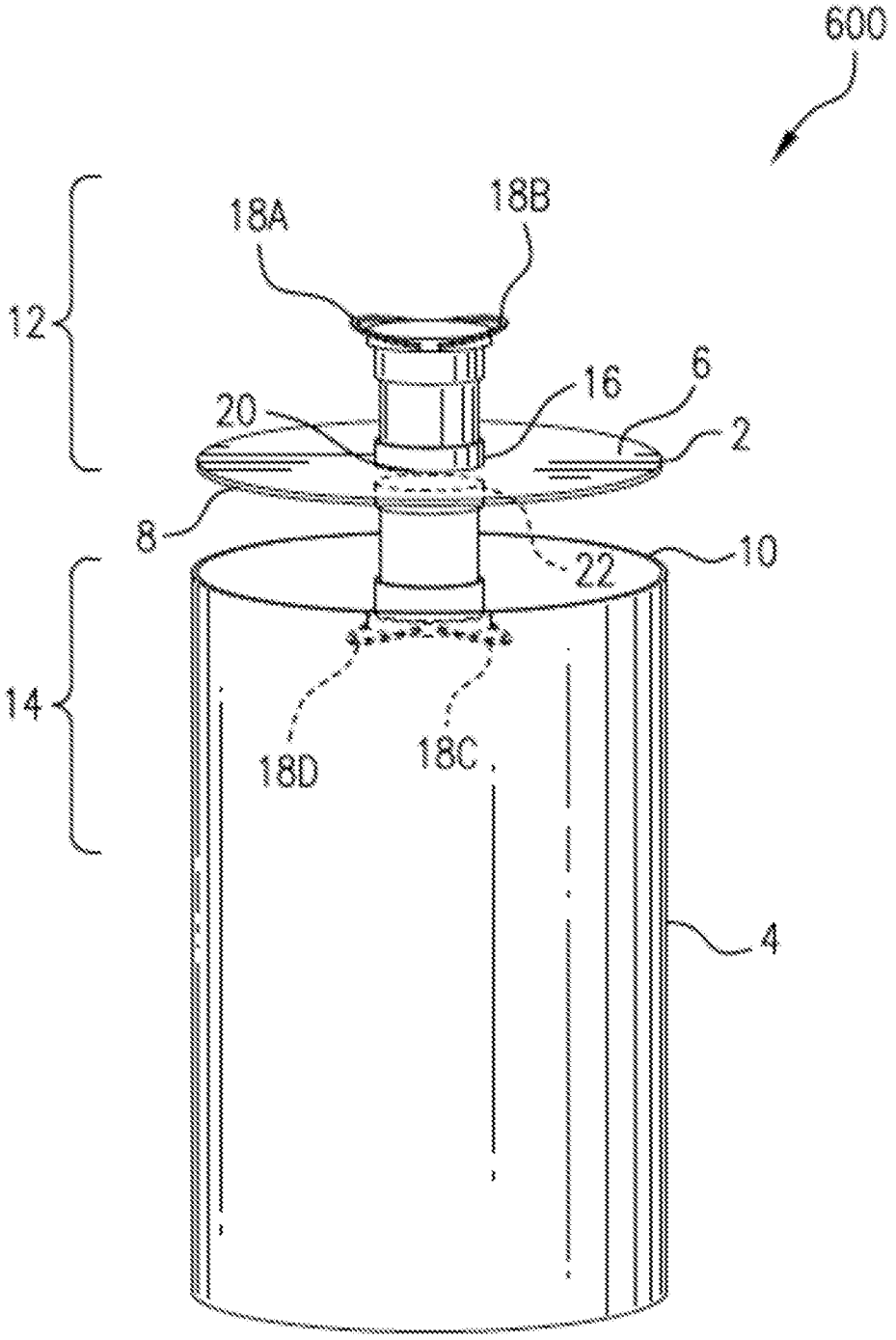
FIG. 6 depicts a perspective view of an embodiment of a first and a second sealing plug in an open position, according to at least some embodiments described herein.
Figure 7:
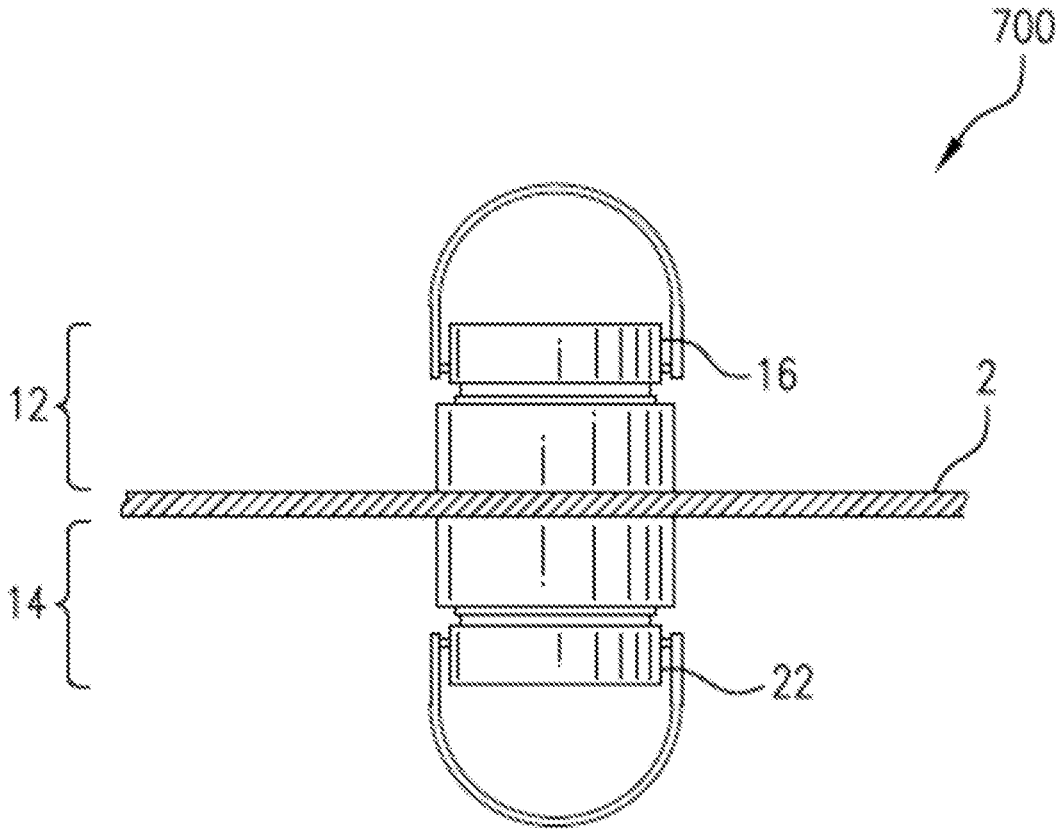
FIG. 7 depicts a perspective view of an embodiment of a first and a second sealing plug in a closed position, according to at least some embodiments described herein.
Figure 8:
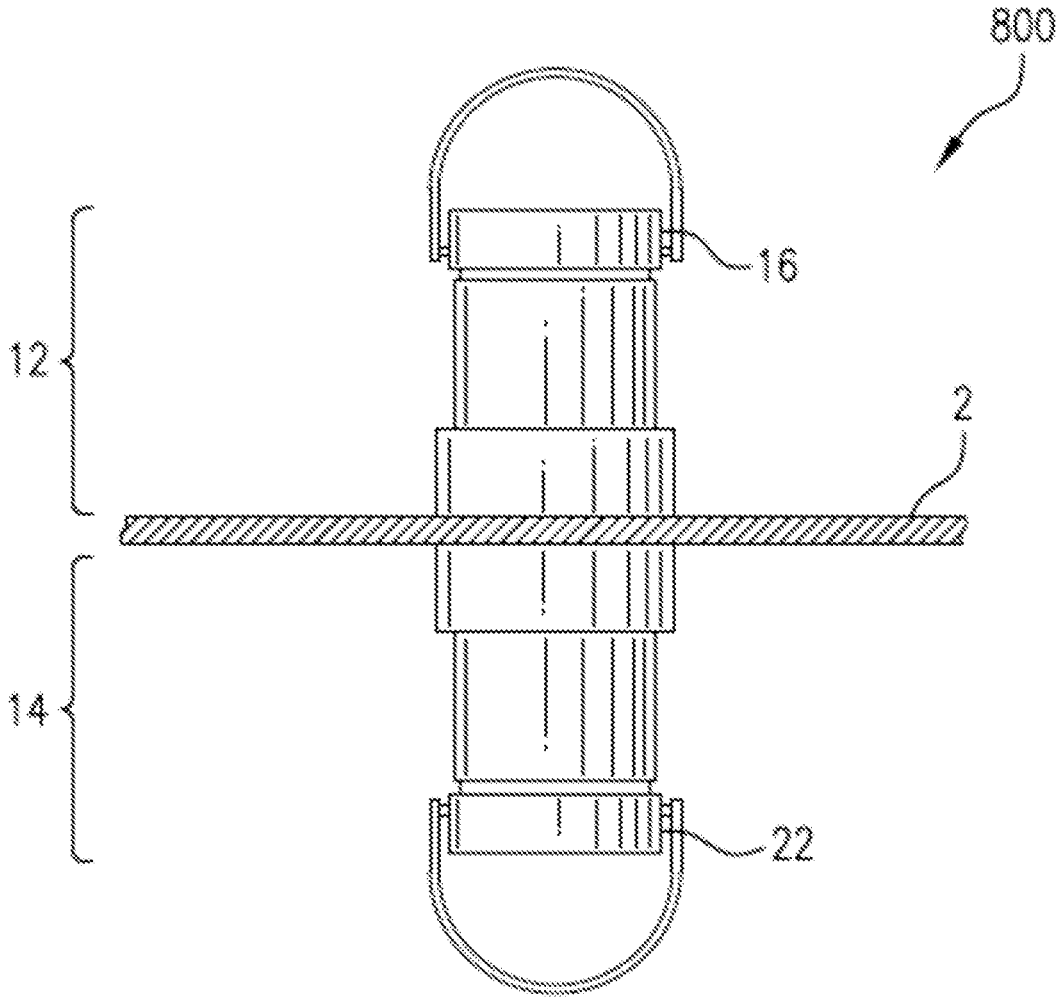
FIG. 8 depicts a perspective view of an embodiment of a first and a second sealing plug in an open position, according to at least some embodiments described herein.

The first sealing plug 16 and the second sealing plug 22 may be in a closed position when a user is not engaging with the closed container (as shown in FIG. 2, FIG. 3, FIG. 5 and FIG. 7). This closed position ensures that non-ingestible items do not enter the collapsible straw or the container 4. If the user wishes to drink from the closed container, the user may pull the one or more pull tabs 18A, 18B of the first sealing plug 16 away from the first side 6 of the lid 2 and the one or more pull tabs 18C, 18D of the second sealing plug 22 away from the second side 8 of the lid 2 to extend the first sealing plug 16 and the second sealing plug 22 to an open position. When the first sealing plug 16 and the second sealing plug 22 are in the open position (as shown in FIG. 6 and FIG. 8), the first portion 12 and the second portion 14 of the collapsible straw are configured in an extended use position, allowing the user to drink from the closed container.

Figure 2:
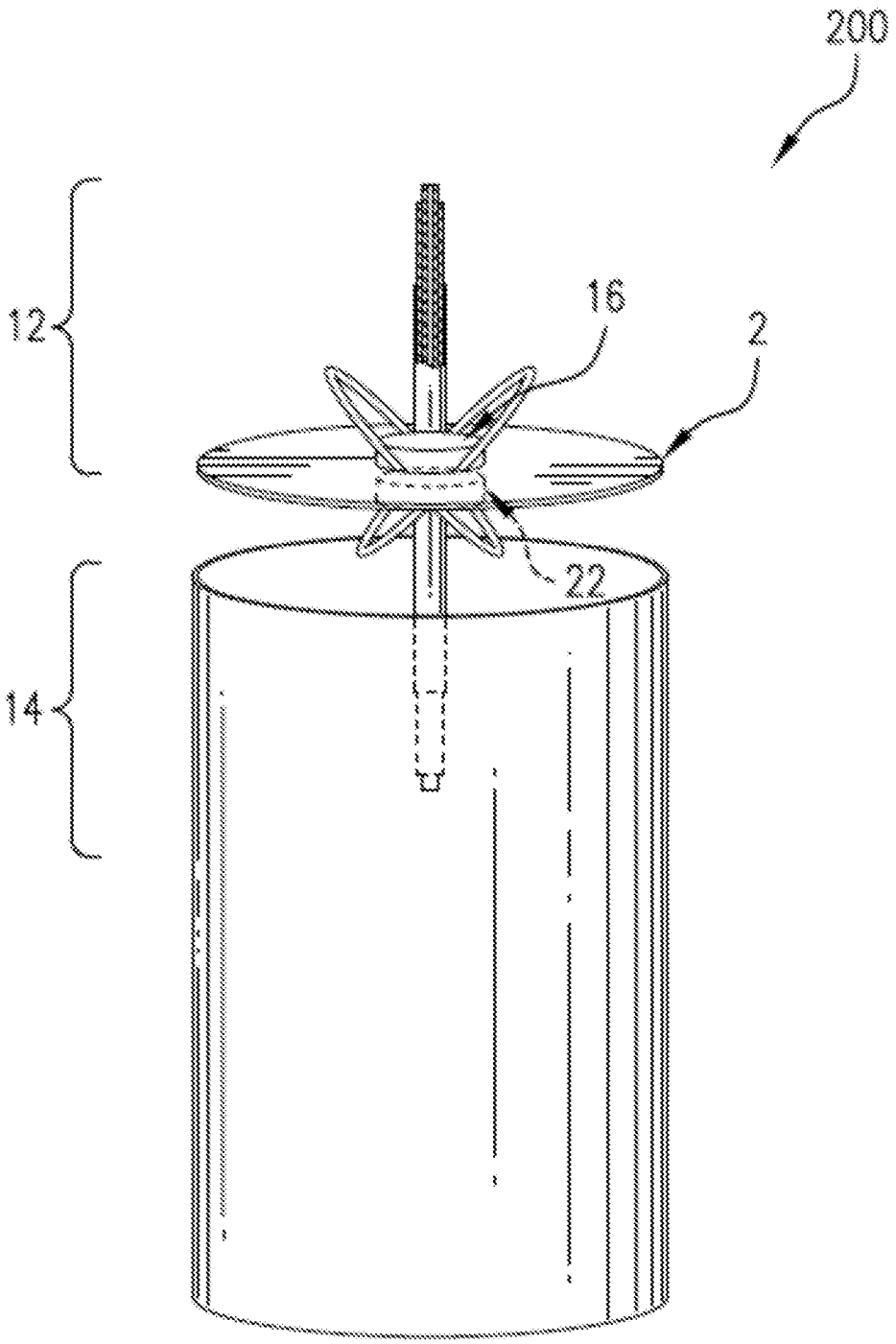
FIG. 2 depicts a perspective view of an embodiment of a telescoping straw in a closed position and a first and a second sealing plug in a closed position, according to at least some embodiments described herein.

Once the user is done engaging with the closed container, the user can push the one or more pull tabs 18A, 18B of the first sealing plug 16 towards the first side 6 of the lid 2 and the one or more pull tabs 18C, 18D of the second sealing plug 22 towards the second side 8 of the lid 2 to condense the first sealing plug 16 and the second sealing plug 22 to a closed position for travel or storage. In the closed position, the first portion 12 and the second portion 14 of the collapsible straw are configured in a collapsed non-use position, disallowing the user to drink from the closed container. In the collapsed non-use position, the collapsible straw may be folded into a compact configuration and may reside against the lid 2 (as shown in FIG. 1). Moreover, in some examples, the collapsible straw may collapse on itself in a telescoping movement (as shown in FIG. 2) when in the collapsed non-use position.

The collapsible straw comprises a rigid external tube and a flexible internal tubing that is foldable to the compact configuration for storage. In the folded configuration, the collapsible straw has a reduced length of approximately one-half to one-fourth of its extended length when in use. However, the reduced length of the collapsible straw is not limited to the lengths explicitly described herein and other lengths are contemplated by Applicant.

Figure 3:
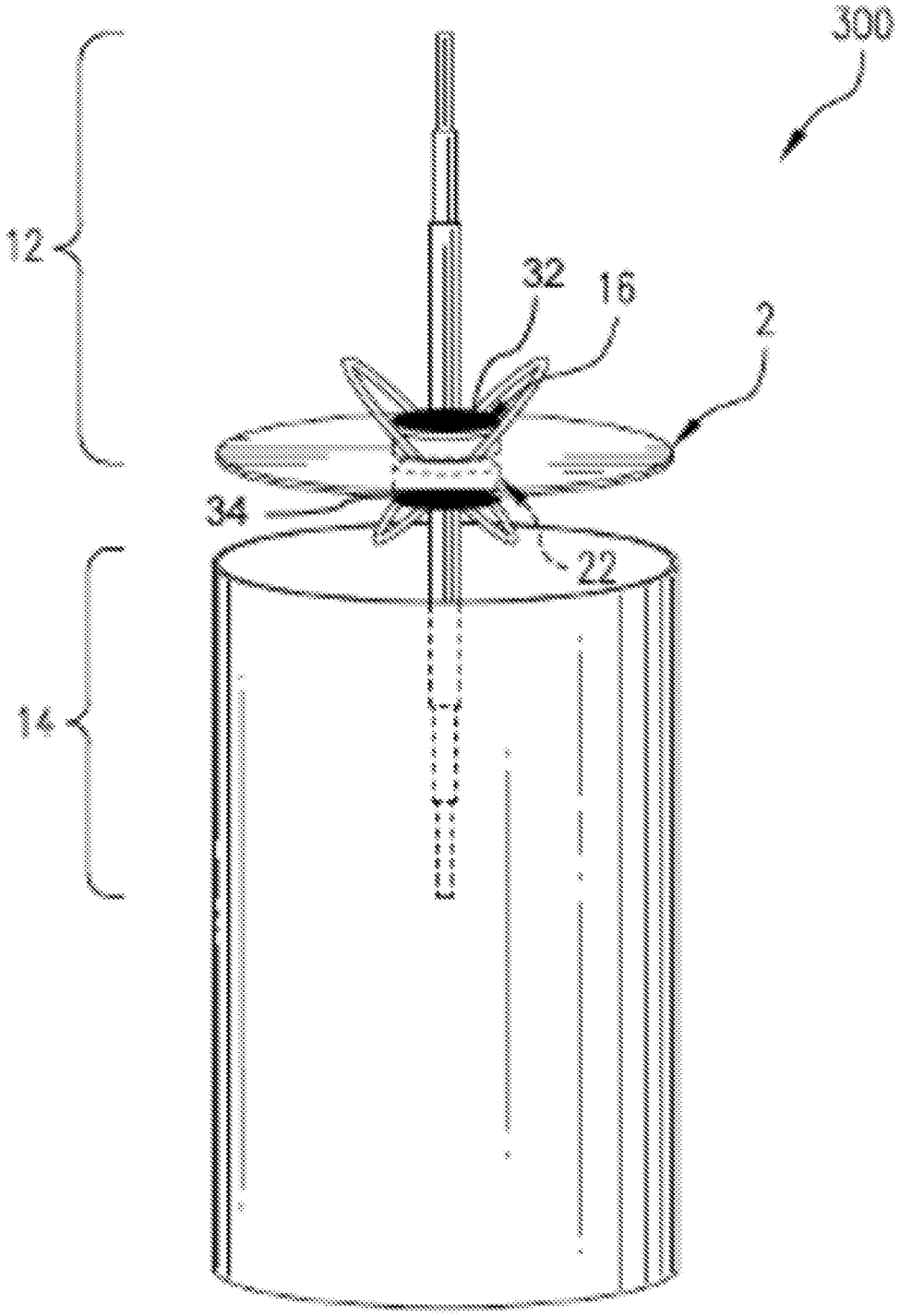
FIG. 3 depicts a perspective view of an embodiment of a telescoping straw in an open position and a first and a second sealing plug in a closed position, according to at least some embodiments described herein.

In some examples, and as shown in FIG. 3, a first sanitary film 32 may be affixed to the first sealing plug 16 and a second sanitary film 34 may be affixed to the second sealing plug 22. The first sanitary film 32 and the second sanitary film 34 may comprise a plastic material. When the user pulls the one or more pull tabs 18A, 18B of the first sealing plug 16 away from the first side 6 of the lid 2 and the one or more pull tabs 18C, 18D of the second sealing plug 22 away from the second side 8 of the lid 2 to extend the first sealing plug 16 and the second sealing plug 22 to the open position, the first sanitary film 32 and the second sanitary film 34 may be removed. In other examples, the sanitary film 32 and the second sanitary film 34 may be removed directly via user action.

In another embodiment, the assembly 100 may comprise a reusable assembly. The reusable assembly may include the same components or substantially the same components described supra with regards to the recyclable assembly. In some examples, the reusable assembly may be housed inside of an enclosed cylinder prior to use to ensure a sanitary condition of the reusable assembly.

In examples, the reusable assembly may comprise a silicone material such that the assembly 100 is dishwasher safe. For example, the first portion 12 and the second portion 14 of the collapsible straw may be fully extendable in the open position to stabilize the reusable assembly in a dishwasher rack during washing. In other examples, the first portion 12 of the collapsible straw may be in the collapsed non-use position or the folded state when placed on the dishwasher rack during washing. In another example, the second portion 14 of the collapsible straw in the collapsed non-use position or the folded state when placed on the dishwasher rack during washing. It should be appreciated that any configuration of the first portion 12 and the second portion 14 of the collapsible straw is contemplated when the reusable assembly is placed on the dishwasher rack during washing. Moreover, it should be appreciated that the collapsibility of the collapsible straw allows for more efficient storage of the reusable assembly by allowing for stacking of multiple reusable assemblies and/or with other standard lid containers.

Figure 4A:
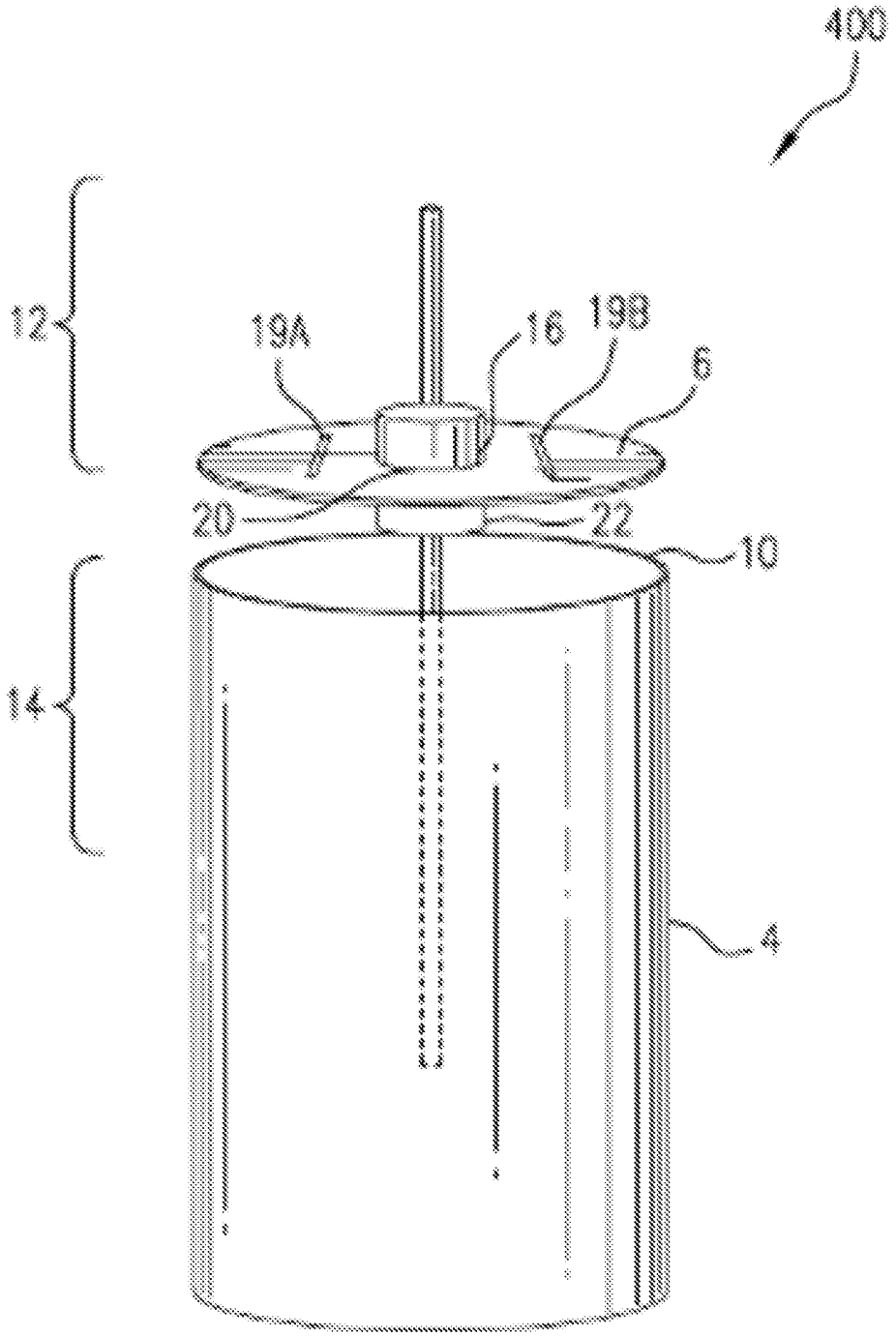
FIG. 4A depicts a perspective view of a preferred embodiment of a collapsible straw, one or more latches, and a first and a second sealing plug in an open position, according to at least some embodiments described herein.
Figure 4B:
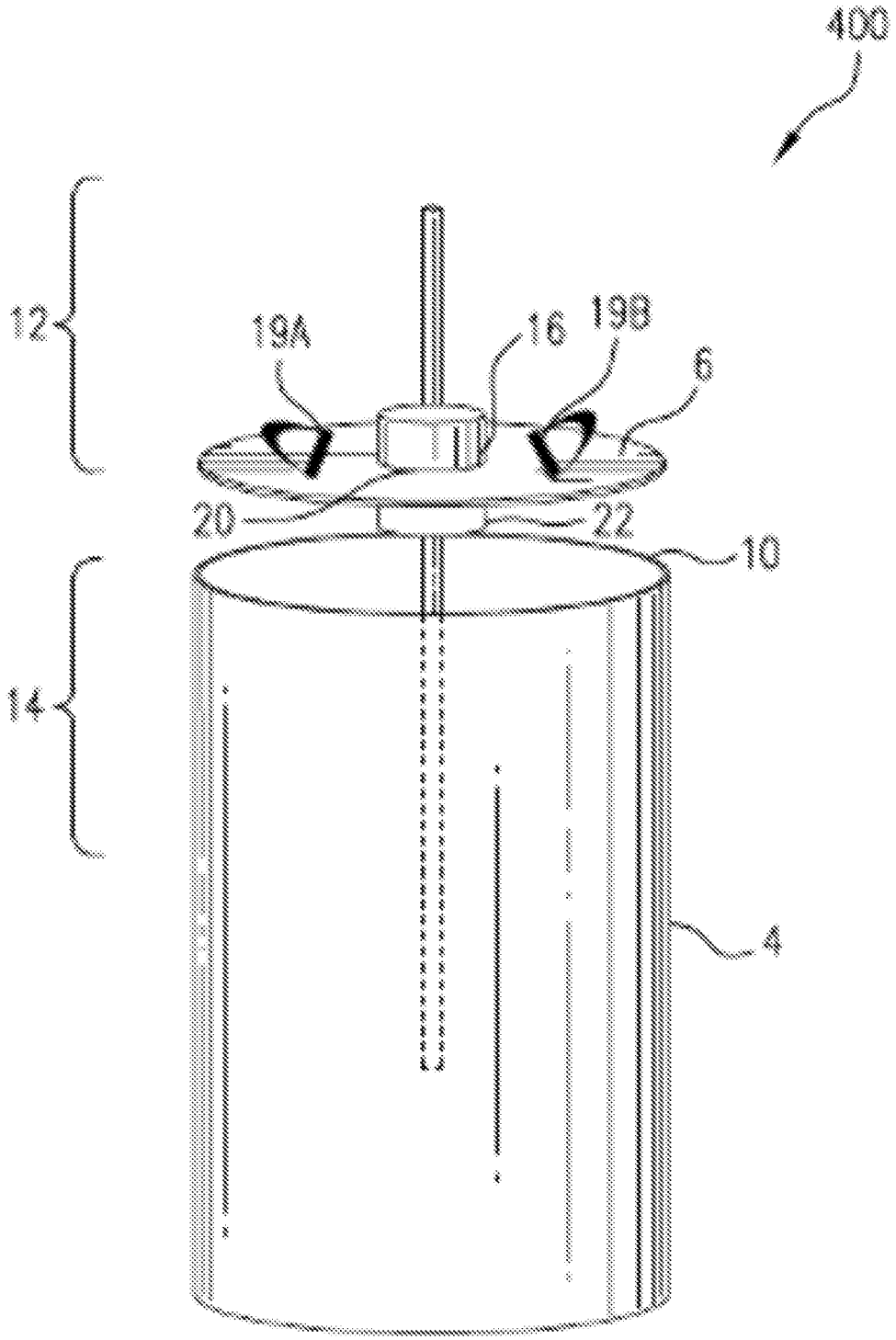
FIG. 4B depicts another perspective view of a preferred embodiment of a collapsible straw, one or more hooks, and a first and a second sealing plug in an open position, according to at least some embodiments described herein.
Figure 5:
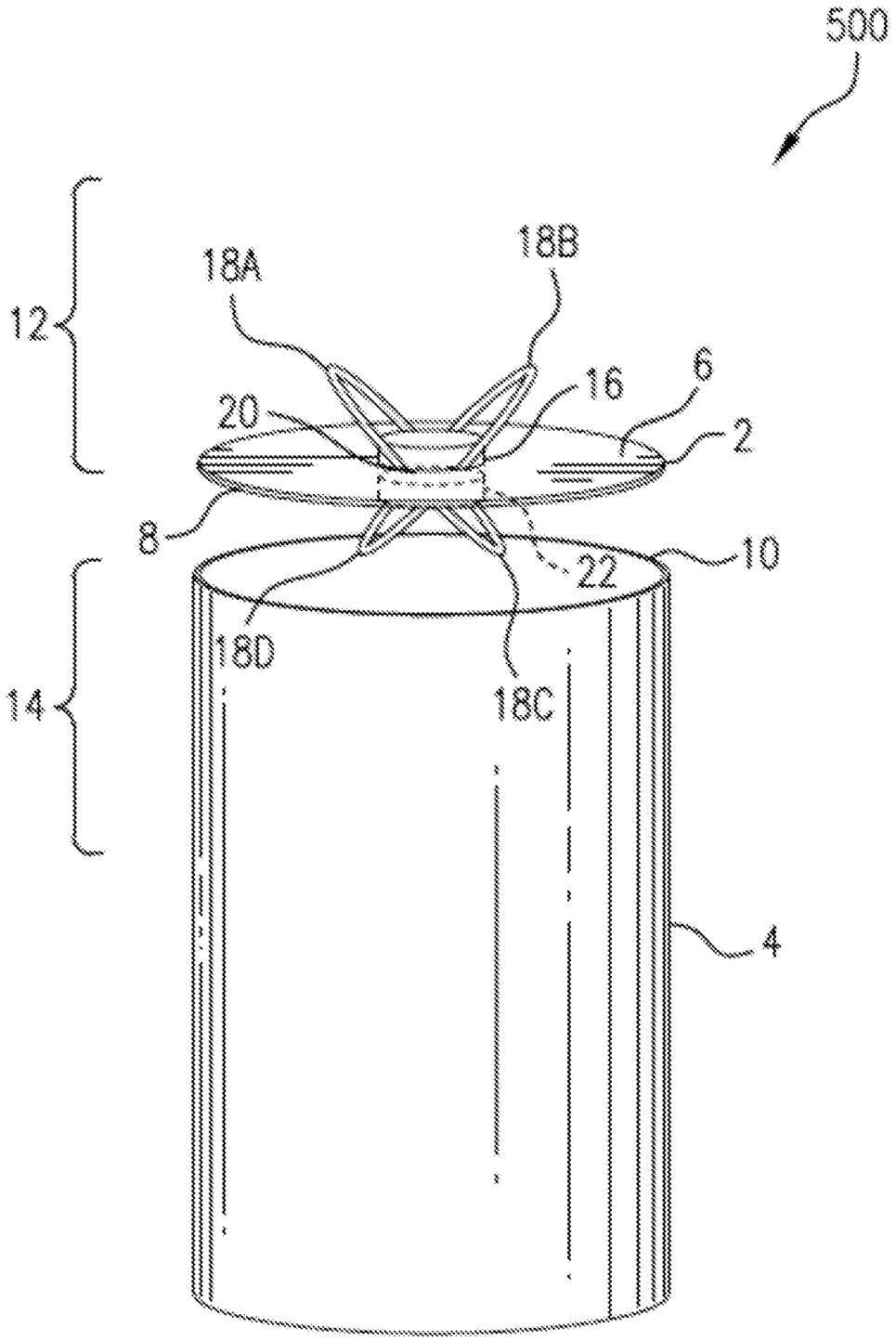
FIG. 5 depicts a perspective view of an embodiment of a first and a second sealing plug in a closed position, according to at least some embodiments described herein.

In some examples, the first sealing plug 16 and/or the second sealing plug 22 are removable from the assembly. Once removed, the first sealing plug 16 and/or the second sealing plug 22 may be recycled. In other examples, the first sealing plug 16 and/or the second sealing plug 22 may be reusable. In this example, the lid 2 may comprise one or more latches (of FIG. 4A) or hooks (of FIG. 4B) 19A, 19B. The one or more latches (of FIG. 4A) or hooks (of FIG. 4B) 19A, 19B may hold or secure the reusable first sealing plug 16 and the second sealing plug 22 to the lid 2. In other examples, the first sealing plug 16 and/or the second sealing plug 22 are not removable from the assembly, and as such, the first sealing plug 16, the second sealing plug 22, the collapsible straw, and the lid 2 may be reused or recycled as one assembly.

The above-referenced disclosure describes one or more embodiments of the instant invention. FIG. 4 depicts a preferred embodiment of the instant invention. In this embodiment, an assembly 400 is depicted, which may be recyclable or reusable. The assembly 400 may comprise a lid 2 and a collapsible straw fully extendable for use. In examples, the lid 2 may have a flat shape, a substantially flat shape, a concave shape, or a domed shape, among other examples.

The lid 2 may have a first side 6 disposed opposite a second side 8. The lid 2 may also have a hole 20 located in a middle of lid 2. The hole 20 is configured to extend through a width of the lid 2. In examples, the second side 8 of the lid 2 may engage an opening 10 of a container 4 to form a closed container. The closed container may house a liquid of any temperature. It should be appreciated that the shape, size, and dimensions of the container 4 are not limited to those depicted.

The collapsible straw may include a first portion 12 disposed opposite a second portion 14. The first portion 12 of the collapsible straw may be bendable or flexible and may have a first side disposed opposite a second side. The flexibility or bendability of the first portion 12 of the collapsible straw allows the first portion 12 of the collapsible straw to bend for ease of use by someone who cannot reach the collapsible straw in a straight and an extended use position. The second portion 14 of the collapsible straw may have a first side disposed opposite a second side.

The first side of the first portion 12 of the collapsible straw is configured to be engaged by a mouth of the user. The second side of the first portion of the collapsible straw is configured to engage the hole 20 on the first side 6 of the lid 2. The first side of the second portion 14 of the collapsible straw is configured to be housed within the closed container. The second side of the second portion 14 of the collapsible straw is configured to engage hole 20 on the second side 8 of the lid 2.

In some examples, the straw may have a corrugated flex pipe configuration. In this example, as depicted, the second side of the first portion 12 of the straw may have a larger width than the first side of the first portion 12 of the straw. Moreover, the second side of the second portion 14 of the straw may have a larger width than the first side of the first portion 12 of the straw.

Differing from the above-referenced examples, the assembly 400 may additionally include a first sealing plug 16 affixed to the first side of the first portion 12 of the collapsible straw and may include a second sealing plug 22 affixed to the first side of the second portion 14 of the collapsible straw. The first sealing plug 16 and the second sealing plug 22 are both tamper-evident caps that provide a resealable closure. The first sealing plug 16 seals an inside of the first portion 12 of the straw and the second sealing plug 22 seals an inside of the second portion 14 of the straw to prevent non-ingestible items from entering the first portion 12 or the second portion 14 of the straw.

It should be appreciated that the first sealing plug 16 may be manufactured to be removable from the assembly 400. In other examples, the first sealing plug 16 may be screwed or secured onto the first side of the first portion 12 of the straw. Moreover, the second sealing plug 22 may be screwed or secured onto the first side of the second portion 14 of the straw. The first portion 12 of the straw may collapse on itself in a direction moving towards the first side 6 of the lid 2. Moreover, the second portion 14 of the straw may collapse on itself in a direction moving towards the second side 8 of the lid 2.

The first sealing plug 16 and the second sealing plug 22 may be in a closed position when a user is not engaging with the closed container. This closed position ensures that non-ingestible items do not enter the collapsible straw or the container 4. If the user wishes to drink from the closed container, the user may pull the one or more pull tabs 18A, 18B of the first sealing plug 16 away from the first side 6 of the lid 2 and the one or more pull tabs 18C, 18D of the second sealing plug 22 away from the second side 8 of the lid 2 to extend the first sealing plug 16 and the second sealing plug 22 to an open position. When in the open position (as shown in FIG. 3, FIG. 6 and FIG. 8), the first portion 12 and the second portion 14 of the collapsible straw are configured in an extended use position, allowing the user to drink from the closed container.

Once the user is done engaging with the closed container, the user can push the one or more pull tabs 18A, 18B of the first sealing plug 16 towards the first side 6 of the lid 2 and the one or more pull tabs 18C, 18D of the second sealing plug 22 towards the second side 8 of the lid 2 to condense the first sealing plug 16 and the second sealing plug 22 to a closed position for travel or storage. In the closed position, the first portion 12 and the second portion 14 of the collapsible straw are configured in a collapsed non-use position, disallowing the user to drink from the closed container. In some examples, in this collapsed non-use position, the first sealing plug 16 houses the first portion 12 of the straw and the second sealing plug 22 houses the second portion 14 of the straw.

As has been explained, in some examples, the first sealing plug 16 and/or the second sealing plug 22 are removable from the assembly. Once removed, the first sealing plug 16 and/or the second sealing plug 22 may be recycled. In other examples, the first sealing plug 16 and/or the second sealing plug 22 may be reusable. In this example, the lid 2 may comprise one or more latches (of FIG. 4A) or hooks (of FIG. 4B) 19A, 19B. The one or more latches (of FIG. 4A) or hooks (of FIG. 4B) 19A, 19B may hold or secure the reusable first sealing plug 16 and the second sealing plug 22 to the lid 2. In other examples, the first sealing plug 16 and/or the second sealing plug 22 are not removable from the assembly, and as such, the first sealing plug 16, the second sealing plug 22, the collapsible straw, and the lid 2 may be reused or recycled as one assembly.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A recyclable assembly comprising:

a lid having a first side disposed opposite a second side and a hole located in a middle of the lid such that the hole extends through a width of the lid, wherein the second side of the lid engages an opening of a container to form a closed container;

a straw fully extendable for use and configured to collapse on itself in a telescoping movement, the straw having a first portion disposed opposite a second portion;

a first sealing plug affixed to the first side of the lid such that the first sealing plug prevents non-ingestible items from entering the container;

a second sealing plug affixed to the second side of the lid such that the second sealing plug seals an inside of the closed container;

wherein the first portion of the straw has a first side disposed opposite a second side, wherein the second portion of the straw has a first side disposed opposite a second side, wherein the second side of the first portion of the straw is configured to engage the hole on the first side of the lid, wherein the second side of the second portion of the straw is configured to engage the hole on the second side of the lid, wherein the second portion of the straw resides inside of the closed container, wherein the first sealing plug and the second sealing plug each comprise at least one pull tab, and wherein when a user pulls the at least one pull tab of the first sealing plug in a direction away from the first side of the lid or the at least one pull tab of the second sealing plug in a direction away from the second side of the lid, the first or the second sealing plug are extended to an open position and the straw is extended, via the telescoping movement, into an extended use position.

2. The recyclable assembly of claim 1, wherein the lid and the straw are manufactured as one piece.

3. The recyclable assembly of claim 1, wherein the straw comprises a recyclable material, and wherein the recyclable material is selected from the group consisting of: a biodegradable plastic, a number 4 plastic, a number 6 plastic, a paper material, and combinations thereof.

4. The recyclable assembly of claim 3, wherein the biodegradable plastic is selected from the group consisting of: a biologically synthesized plastic and a petroleum-based plastic, wherein the biologically synthesized plastic is selected from the group consisting of: a polyhydroxyalkanoates (PHA) plastic, a polylactic acid (PLA) plastic, a starch blend plastic, and a cellulose-based plastic, and wherein the petroleum-based plastic is selected from the group consisting of: a polyglycolic acid (PGA) plastic, a polybutylene succinate (PBS) plastic, a polycaprolactone (PCL) plastic, a poly(vinyl alcohol) (PVOH/PVA) plastic, and a polybutylene adipate terephthalate (PBAT) plastic.

5. The recyclable assembly of claim 3, wherein the number 4 plastic is a low-density polyethylene (LDPE) plastic.

6. The recyclable assembly of claim 3, wherein the number 6 plastic is a polylactic acid plastic or a polystyrene plastic.

7. The recyclable assembly of claim 1, wherein the lid comprises a material selected from the group consisting of: a plastic material, a paper material, a recyclable material, and combinations thereof, and wherein the plastic material is selected from the group consisting of: a biodegradable plastic, a number 4 plastic, and a number 6 plastic.

8. The recyclable assembly of claim 1, wherein one or more of the first sealing plug and the second sealing plug are removable.

9. The recyclable assembly of claim 1, wherein when the user pushes the at least one pull tab of the first sealing plug in a direction towards the first side of the lid or the at least one pull tab of the second sealing plug in a direction towards the second side of the lid, the first or the second sealing plug are condensed to a closed position and the straw is collapsible, via the telescoping movement, into a closed non-use position for storage inside of the first or the second sealing plug.

10. A reusable assembly comprising:

a lid having a first side disposed opposite a second side and a hole located in a middle of the lid such that the hole extends through a width of the lid, wherein the second side of the lid engages an opening of a container to form a closed container;

a straw fully extendable for use and configured to collapse on itself in a telescoping movement, the straw having a corrugated flex pipe configuration and having a first portion disposed opposite a second portion;

a first sealing plug affixed to the first side of the lid such that the first sealing plug prevents non-ingestible items from entering the container; and a second sealing plug affixed to the second side of the lid such that the second sealing plug seals an inside of the closed container, wherein the first portion of the straw has a first side disposed opposite a second side, wherein the second portion of the straw has a first side disposed opposite a second side, wherein the second side of the first portion of the straw is configured to engage the hole on the first side of the lid, wherein the second side of the second portion of the straw is configured to engage the hole on the second side of the lid, wherein the second portion of the straw resides inside of the closed container, wherein the first sealing plug and the second sealing plug each comprise at least one pull tab, and wherein when a user pulls the at least one pull tab of the first sealing plug in a direction away from the first side of the lid or the at least one pull tab of the second sealing plug in a direction away from the second side of the lid, the first or the second sealing plug are extended to an open position and the straw is extended, via the telescoping movement, into an extended use position.

11. The reusable assembly of claim 10, wherein the reusable assembly comprises a silicone material such that the reusable assembly is dishwasher safe.

12. The reusable assembly of claim 10, wherein one or more of the first sealing plug and the second sealing plug are removable.

13. The reusable assembly of claim 12, wherein a first sanitary film is affixed to the first sealing plug, and wherein a second sanitary film is affixed to the second sealing plug such that when the user pulls the at least one pull tab of the first sealing plug in a direction away from the first side of the lid or the at least one pull tab of the second sealing plug in a direction away from the second side of the lid to extend the first or the second sealing plug to an open position, the first sanitary film or the second sanitary film is removed.

14. A recyclable or reusable assembly comprising:

a lid having a first side disposed opposite a second side and a hole located in a middle of the lid such that the hole extends through a width of the lid, wherein the second side of the lid engages an opening of a container to form a closed container;

a first sealing plug affixed to the first side of the lid;

a first sanitary film affixed to the first sealing plug;

a second sealing plug affixed to the second side of the lid;

a second sanitary film affixed to the second sealing plug; and a straw fully extendable for use and configured to collapse on itself in a telescoping movement, the straw having a corrugated flex pipe configuration and having a first portion disposed opposite a second portion, wherein the first portion of the straw has a first side disposed opposite a second side, wherein the second portion of the straw has a first side disposed opposite a second side, wherein the second side of the first and the second portion of the straw has a greater width than the first side of the first and the second portion of the straw, wherein the second side of the first portion of the straw is configured to engage the hole on the first side of the lid, wherein the second side of the second portion of the straw is configured to engage the hole on the second side of the lid, wherein the second portion of the straw resides inside of the closed container, wherein the first sealing plug and the second sealing plug each comprise at least one pull tab, and wherein when a user pulls the at least one pull tab of the first sealing plug in a direction away from the first side of the lid or the at least one pull tab of the second sealing plug in a direction away from the second side of the lid, the first or the second sealing plug are extended to an open position and the straw is extended, via the telescoping movement, into an extended use position.

15. The recyclable or reusable assembly of claim 14, wherein a shape of the lid is a flat shape.

* * * * *